United States Patent [19]

Holland

[11] Patent Number: 4,512,233

[45] Date of Patent: Apr. 23, 1985

[54] PITCH ADJUSTER

[76] Inventor: Jack O. Holland, 2722 Brentwood Blvd., St. Louis, Mo. 63144

[21] Appl. No.: 552,923

[22] Filed: Nov. 18, 1983

[51] Int. Cl.[3] ..... G10D 9/00

[52] U.S. Cl. ..... 84/394; 84/387 R; 84/396

[58] Field of Search ..... 84/394, 387 R, 388, 84/396

[56] References Cited

U.S. PATENT DOCUMENTS

| | | | |
|---|---|---|---|
| 550,967 | 12/1895 | Harris | 84/394 |
| 622,820 | 4/1899 | Neumann | 84/394 |
| 828,273 | 8/1906 | Conn | 84/394 |
| 1,003,049 | 9/1911 | Jay | 84/394 |
| 1,061,885 | 5/1913 | Todt | 84/394 |
| 1,201,039 | 10/1916 | Gronert et al. | 84/394 |
| 1,218,057 | 1/1917 | Conn | 84/394 |
| 1,277,012 | 8/1918 | White | 84/394 |
| 1,662,076 | 3/1928 | Newman | 84/394 |
| 2,734,417 | 2/1956 | Hindsley | 84/394 |
| 2,738,696 | 3/1956 | Ritterbach | 84/394 |
| 3,161,103 | 12/1964 | Pascucci et al. | 84/394 |
| 3,433,114 | 3/1969 | Seme | 84/394 |
| 3,507,181 | 4/1970 | Cardwell, Jr. | 84/388 |
| 4,276,804 | 7/1981 | Holland | 84/394 |

*Primary Examiner*—Lawrence R. Franklin
*Attorney, Agent, or Firm*—Rogers, Howell, Renner, Moore & Haferkamp

[57] ABSTRACT

A pitch adjuster for a valved brass instrument having a tuning slide crook for selectively operating the tuning slide crook between a normal position, a preselected inward position, and a preselected outward position, to raise or lower the note played. The pitch adjuster comprises a main rod mounted to the tuning slide crook and slideably mounted in a ring to the instrument. Stops on the rod limit the inward and outward movement of the rod and tuning slide crook to predetermined positions, by engaging the ring. The outer end of a spring is engaged on the rod and the inner end is engaged by a collar which is held from inward motion from the normal position, so that the spring is compressed when the rod and crook move inward and exerts an outward restorative force on the rod only when the rod is in inward from a normal position. An auxiliary rod is mounted on the inward side of the collar, parallel to the main rod. The inward end of a second spring is engaged on the auxiliary rod and the outward end is engaged and held from outward movement by a ring which slideably receives the auxiliary rod, so that the second spring is compressed when the rod and crook move outward and exerts an inward restorative force on the rod only when the rod is in an outward from normal position. The separate apparatus for restoring the rod and tuning slide crook from an inward and from an outward position define a positive, stopped, normal position and prevent over travel of the rod and crook upon return to a normal position from either the outward or inward positions.

11 Claims, 12 Drawing Figures

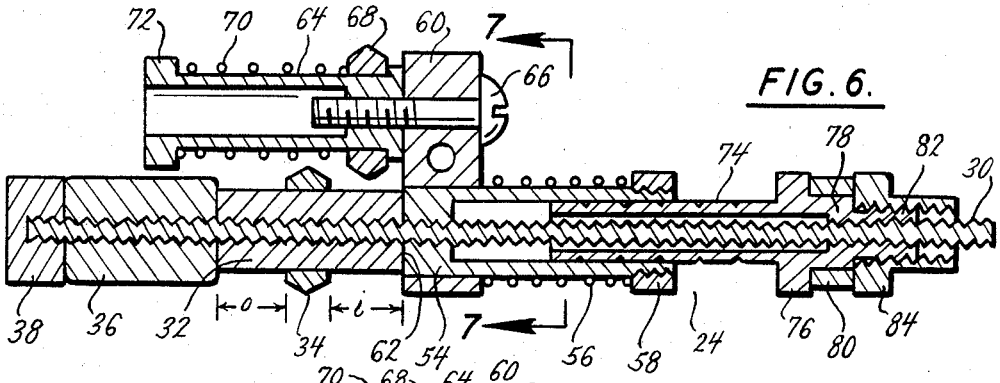
FIG. 6.
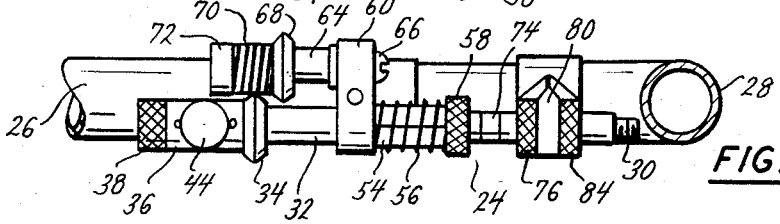
FIG. 8.
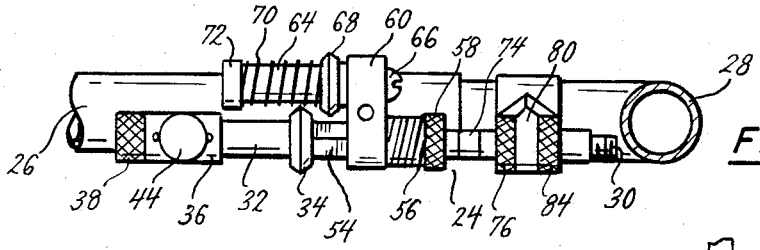
FIG. 9.
FIG. 12.
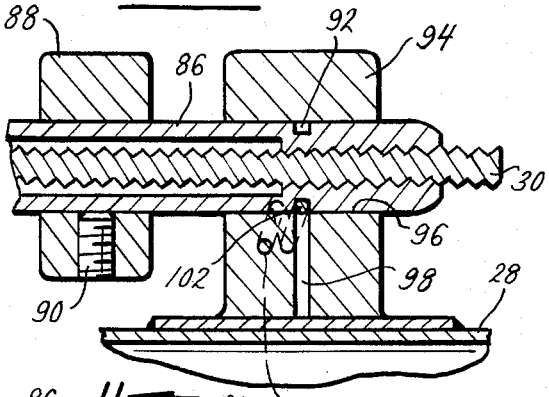
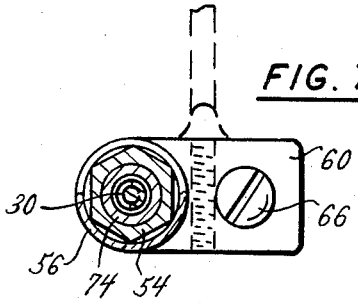
FIG. 7.
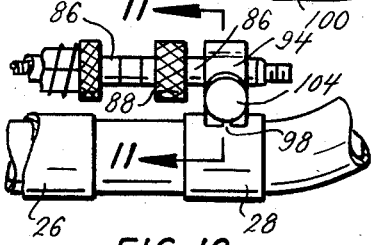
FIG. 10.
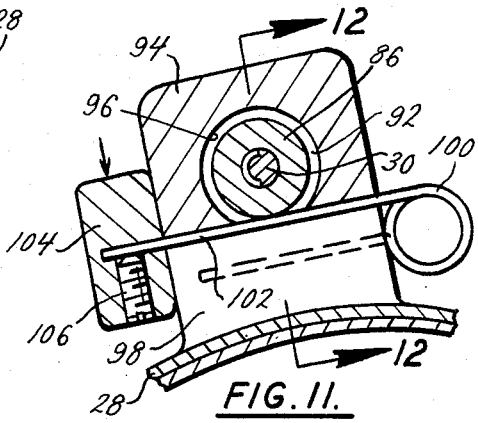
FIG. 11.

PITCH ADJUSTER

BACKGROUND AND SUMMARY OF THE INVENTION

This invention relates to musical instruments, and in particular to a device for use with any valved brass instrument to adjust the pitch of the note to conform to the scale of just intonation.

The notes of a melody are selected to produce consonance in the successive groupings of notes. The notes from which the selection can be made constitute a musical scale. Western music is composed from the diatonic scale, an eight note scale whose eighth note is a repetition of the first. There are actually two such scales, a major scale and a minor scale, and each is constructed from chords or triads of consonant combinations of notes whose frequencies are in certain empirically determined ratios. There is a varying, but patterned relationship between each successive note in each of these scales. A scale patterned exactly according to these frequency relationships is a scale of just intonation.

The key note is the starting point of the scale, and to accomodate different voices and different instruments, it is desirable to build scales upon several key notes. However, to perform a melody in the scale of just intonation of several key notes would require a large number of notes. It would be difficult to construct or to play an instrument that could produce the sufficient number of notes, and thus a scale has been developed with twelve notes with equal intervals between consecutive notes. This scale, known as the scale of equal temperament, can be divided into 1200 cents, with the interval between each note being 100 cents. Eight note scales approximating scales of just intonation can be constructed from the notes of the equal temperament scales, thus, the scale of equal temperament permits the musician to approximate the scale of just intonation, although there are perceptible differences.

The differences between the scale of just intonation and the scale of equal temperament were explained in my prior U.S. Pat. No. 4,276,804. There it was developed that for each note in the twelve note equal temperament scale to occupy each position in the major and minor scales of just intonation, ten adjustments in pitch would be required. These adjustments range between raising the note 18 cents and reducing the note 16 cents. It would be as difficult to provide these adjustments as it would be to construct and play an instrument in the scale of just intonation. However, it was disclosed in U.S. Pat. No. 4,276,804 that by providing three conditions: a plus sixteen cents, a normal, and a minus 14 cents adjustments, an instrument playing in the scale of equal temperament can much more accurately approach the scale of just intonation. In fact, the maximum deviation from any note would be four cents on the plus side and two cents on the minus side.

In valved brass instruments, to which the present invention pertains, the musician's lips excite the column of air in the instrument, which responds by resonance. The air column vibrates at a constant rate determined by the length of the tube. Different notes of the equal temperament scale can be played by varying the length of the tube, which is accomplished by actuating the valves to add lengths of tubing. Minor adjustments, such as to conform the notes of the equal temperament scale to the scale of just intonation, could be made by a technique called lipping, but this results in loss of resonant tone quality and disturbance of the ideal playing embouchure, or position of the mouth on the mouthpiece.

Minor adjustments could also be made by slight adjustments in the length of the tubing. Valved brass instruments do, in fact, have a tuning slide crook by which the tuning of the instrument can be adjusted. However, until the invention of the device disclosed in U.S. Pat. No. 4,276,804, there was no practical device to accurately raise or lower the pitch of individual notes in a series to conform to the scale of just intonation under actual playing conditions. Cumbersome devices for changing the key of instruments by manipulating the tuning slide crook or other slide crooks were known, for example, U.S. Pat. Nos. 622,820, 828,273, 1,003,049, and 3,433,114. However, these could not be used to successfully change notes to the scale to just intonation, but merely raised or lowered all the notes played. Other gadgets have been made that adjusted the pitch of the notes by adjusting slide crooks, but despite their complexities and difficulty of operation they did not provide a way to accurately adjust the pitch according to the scale of just intonation. Some of these devices provided a means for adjustment, which the musician made by ear, for example, U.S. Pat. Nos. 550,967, 1,662,076, and 2,738,696. Some of these devices acted only on certain notes for a special purpose, for example, U.S. Pat. No. 3,161,103 shows a device to flatten notes involving the first valve. Finally, most of these devices were limited to trumpets or cornets and did not solve the adjustment problem for other valved brass instruments.

Clearly, the device of U.S. Pat. No. 4,276,804 was the first device for all valved brass instruments to provide a simple, practical way to adjust all notes in either direction to conform to the scale of just intonation. This was accomplished by providing a simple actuating device to move the tuning slide crook having preselected stopped, raised, and lowered positions, so that by operating the device between three positions; the raised, lowered, and normal positions, all the notes of the scale of equal temperament could be conformed to the scale of just intonation within a mere plus for cents or minus two cents.

The present invention is an improvement upon my prior device. The present invention, like my prior device, is adaptable to any valved brass instrument. This new invention is particularly suitable for installation on any instrument, as it need only be attached to the tuning slide crook and the fixed tube in which the tuning slide crook is slideably mounted.

The invention comprises a rod which is mounted to the tuning slide crook of the instrument and slideably mounted to a fixed portion of the instrument so that by sliding the rod, the tuning slide crook can be adjusted. This invention, like my prior device, includes stops that limit the movement of the rod and, thus the tuning slide crook, to preselected inward and preselected outward positions, to raise or lower the note played a predetermined amount. However, this invention also includes means for biasing the rod and tuning slide crook to the normal position. This means includes separate means for biasing the rod and tuning slide crook from any inward position to the normal position and means for biasing the rod and tuning slide crook from any outward position to the normal position. Because of these biasing means, the tuning slide crook cannot be inadvertently or accidentally moved from the normal position. Furthermore, these means act to form a definite normal position, which makes restoration to the normal from a more inward or outward position faster, easier, and more accurate. The separate biasing means are arranged so that while one is operating, the other does not operate or oppose its operation. This makes the automatic return to the normal position very fast, since the movement is not opposed, and thus, the device can be used to adjust individual notes in a series. Another improvement of this invention is the provision of a highly adjustable actuating means so that operation of the device will not interfere with the musician's established method of holding and playing the instrument. Still another improvement is the provision of nylon or other polymeric material washers on the contact surfaces to silence the operation of the device.

BRIEF DESCRIPTION OF THE DRAWINGS

FIG. 6 is a cross-sectional view of the pitch adjuster taken along line 6—6 in FIG. 1;

FIG. 7 is a cross-sectional view of the pitch adjuster taken along line 7—7 in FIG. 6;

FIG. 8 is a top view of the pitch adjuster in the outward position;

FIG. 9 is a top view of the pitch adjuster in the inward position;

FIG. 10 is a partial side view of the pitch adjuster, showing an alternative means for mounting the adjuster to the tuning slide crook;

FIG. 11 is a partial cross-sectional view of the pitch adjuster, taken along line 11—11 in FIG. 10, showing the alternative means for mounting the adjuster to the tuning slide crook;

FIG. 12 is a partial cross-sectional view of the pitch adjuster taken along line 12—12 in FIG. 11, showing the alternative means for mounting the adjuster to the tuning slide crook.

DETAILED DESCRIPTION OF THE PREFERRED EMBODIMENT

Figures 1, 2, 3, 4, 5:
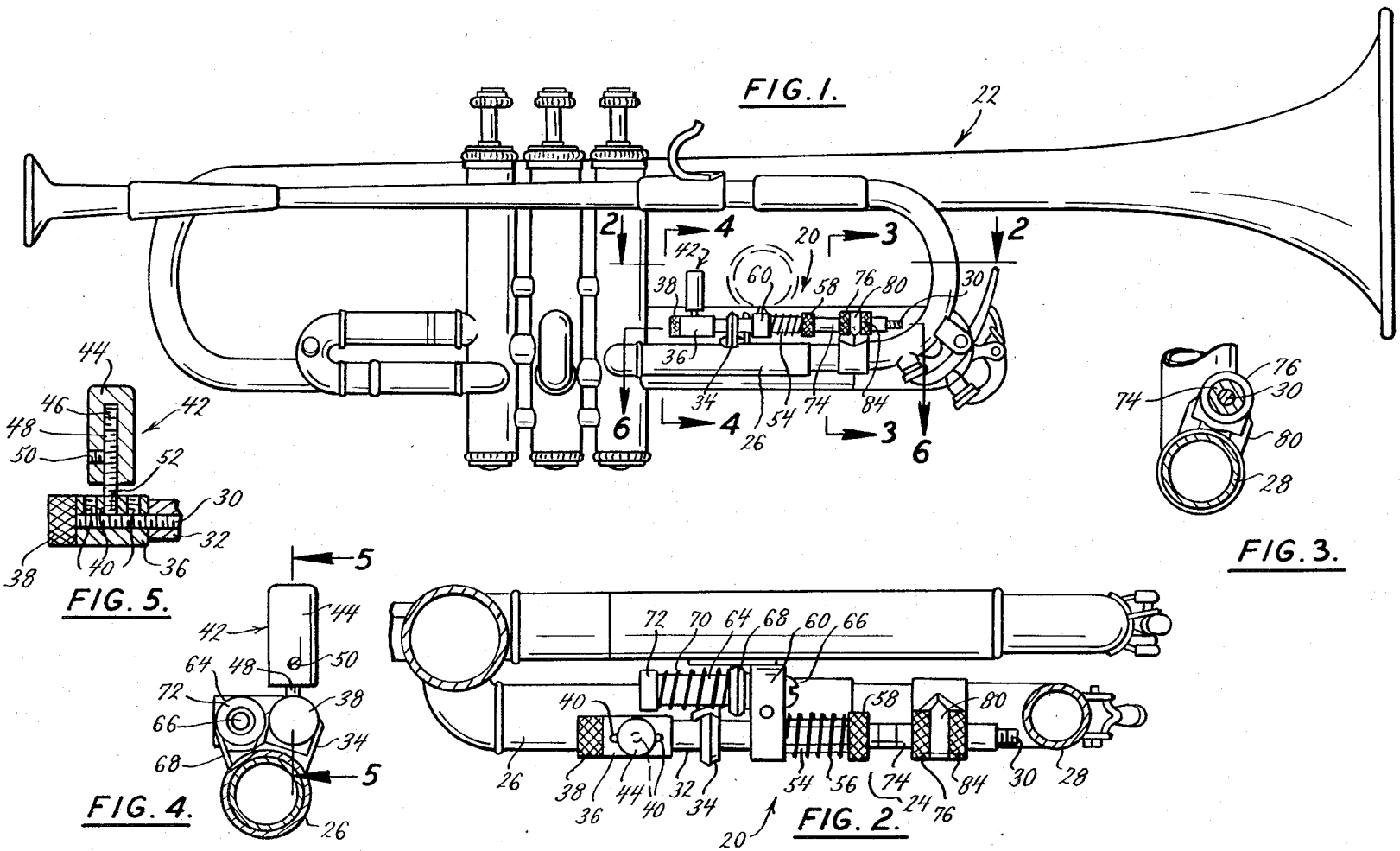
FIG. 1 is a side view of a typical valved brass instrument, a trumpet, showing the pitch adjuster of this invention mounted thereon.
FIG. 2 is a partial cross-sectional view of the trumpet, taken along line 2—2 in FIG. 1, showing the top of the pitch adjuster.
FIG. 3 is a partial cross-sectional view of the trumpet and pitch adjuster, taken along line 3—3 in FIG. 1.
FIG. 4 is a partial cross-sectional view of the trumpet, taken along line 4—4 in FIG. 1, showing the inward end of the pitch adjuster.
FIG. 5 is a partial cross-sectional view of the pitch adjuster, taken along line 5—5 in FIG. 4, showing the actuating handle.

A pitch adjuster constructed according to the principles of this invention, indicated generally as 20 in FIG. 1, is shown as it might be installed on a typical valved brass instrument, trumpet 22. Although the figures and description refers specifically to a trumpet, applicant's pitch adjuster may be readily adapted to any valved brass instrument, and such adaptations are included within the scope of this invention. The pitch adjuster can be installed on the non-moving portion of any valved brass instrument, and operatively engaged to any of the tuning slide crooks.

The pitch adjuster 20 comprises a main rod 24, the inner end of which is slideably mounted to fixed tube 26 to trumpet 22, and the outer end of which is fixedly but adjustably mounted to the tuning slide crook 28. Tuning slide crook 28 is telescopically received in fixed tube 26. Tuning slide crook 28 is provided on a valved brass instrument to allow the musician to tune the instrument. With applicant's pitch adjuster, tuning slide crook 28 is also operated to raise or lower individual notes to approximate the scale of just intonation. The pitch adjuster provides three stopped positions: a normal position, an inward position raising the notes 16 cents, and an outward position lowering the notes 14 cents. The exact amount of inward (i) and outward (o) movement to attain these adjustments depends on the particular instrument, and can be easily calculated by one skilled in the art. The table gives the amount of inward (i) and outward (o) movement required for representative brass instruments:

| INSTRUMENT | (i) +16 cents | (o) −14 cents |
|---|---|---|
| B♭ Trumpet | .304 in. | .266 in. |
| C Trumpet | .271 | .237 |
| D Trumpet | .241 | .211 |
| E♭ Trumpet | .227 | .199 |
| F Trumpet | .215 | .188 |
| G Trumpet | .181 | .158 |
| A Trumpet | .161 | .141 |
| B♭ Trumpet (picc) | .152 | .133 |
| E♭ Alto Horn | .454 | .398 |
| B♭ Tenor & Baritone Horns | .608 | .532 |
| B♭ Tuba | 1.216 | 1.064 |

As best shown in FIG. 6, main rod 24 comprises threaded base rod 30. A cylindrical sleeve 32 is mounted on base rod 30. Sleeve 32 is slideably received in ring 34, which is mounted, as by soldering, to fixed tube 26 of trumpet 22. The length of sleeve 32 is determined by the characteristics of the particular instrument, being the sum of the inward movement (i), the outward movement (o), and the thickness of the ring 32.

At the inward end of sleeve of 32 is a stop to engage ring 34 and limit outward movement of rod 24. In the preferred embodiment, the stop is cylindrical handle bracket 36, which is secured on base rod 30 by end cap 38. The end of bracket 36 can be provided with a nylon or other polymeric washer to help silence the operation of the pitch adjuster. As shown in FIG. 5, bracket 36 has a plurality of axially spaced threaded radial holes 40 to receive handle 42. Handle 42 comprises knob 44 which has an axial bore 46 telescopically receiving pin 48. A set screw 50 adjustably secures pin 48 in bore 46. The bottom 52 of pin 48 is threaded to fit holes 40. The position of handle 42 is adjustable to the particular musician axially, by securing handle 42 in various holes 40; angularly, by loosening cap 38 and turning bracket 36; and radially, by loosening set screw 52 and moving knob 44 with respect to pin 48.

Referring back to FIG. 6, at the outward end of sleeve 32 is a second stop to engage ring 34 and limit inward movement of rod 24. In the preferred embodiment, the second stop is spring retainer 54, of hexagonal cross section, mounted on base rod 30. Because of the differences in the shapes of cylindrical sleeve 32 and hexagonal spring retainer 54, sleeve 32 readily passes through ring 34, but retainer 54 does not, instead retainer 54 engages ring 34 limiting further inward movement of rod 30. The end of retainer 54 can be provided with a nylon or other polymeric washer to help silence the operation of the pitch adjuster. A coil spring 56 is mounted on retainer 54. The outward end of spring 56 is engaged by nut 58 threaded on the outward end of retainer 54. The inward end of spring 56 is engaged by connector 60, which is slideably mounted on retainer 54, connector 60 having a hexagonal aperture therein for slideably receiving retainer 54. Connector 60 is fixed against inward movement at the juncture 62 between cylindrical sleeve 32 and hexagonal spring retainer 54. Because of the differences in the shapes of hexagonal spring retainer 54 and cylindrical sleeve 32, connector 60 readily passes over retainer 54 but not over sleeve 32, instead being caught at juncture 62 and held from further inward movement.

Connector 60 extends laterally, and an auxiliary rod 64 is mounted thereon, extending inwardly from connector 60 parallel to rod 24. Arm 64 is secured to connector 60 with screw 66. Arm 64 is slideably received in ring 68, which is mounted to fixed tube 26 of trumpet 22. Ring 68 is positioned to abut the inward side of connector 60 when rod 24 is in the neutral position. A coil spring 70 is mounted on auxiliary rod 64. The inward end of spring 70 is engaged by shoulder 72 on auxiliary rod 64, and the outward end of spring 70 is engaged by ring 68.

Two methods are contemplated for adjustably securing the outward end of rod 24 to tuning slide crook 28. In the first, a tuning piece 74 is threadedly mounted on the outward end of base rod 30. Tuning piece 74 has knurled knob 76 and an adjacent neck 78 which is rotatably received in ring 80 mounted on the tuning slide crook 28, as by soldering. Tip 82 of tuning piece 74 protrudes beyond ring 80 and is threaded. End knob 84 is threaded onto tip 82 to secure ring 80 and tuning piece 74. Turning knurled knob 76 causes tuning piece 74 and thus tuning slide crook 28 to move axially with respect to base rod 30. This permits tuning of the instrument independent of pitch adjuster 20, which remains in the normal position.

The second method for securing the outward end of rod 24 to tuning slide crook 28 is shown in FIGS. 10–12. A tuning piece 86 is threadedly mounted on the outward end of base rod 30. A knurled knob 88 is mounted on piece 86 as by set screw 90. A circumferential groove 92 is provided in piece 86 near the outward tip. A block 94 is mounted onto tuning slide crook 28 as by soldering. Block 94 has a bore 96 for receiving the tip of tuning piece 86. Block 94 also has a slot 98 perpendicular to the axis of bore 96 and intersecting the bottom of bore 96. One end of a spring 100 is anchored in a hole in the side of block 94, and spring arm 102 extends across block 94 in slot 98, impinging on the bottom of bore 96, and protruding from the side of block 94 where it is capped with button 104 secured by set screw 106. When tuning piece 86 is disposed in bore 96, spring arm 102 engages groove 92, securing the tuning piece and block against relative axially movement. The tuning piece can be quickly removed by depressing knob 104 which moves spring arm 102 downward into slot 98 out of engagement with groove 92. When tuning piece 86 is properly installed in block 94, turning knurled knob 88 causes tuning piece 86 and thus tuning slide crook 28 to move axially with respect to base rod 30. This permits tuning of the instrument independent of pitch adjuster 20 which remains in the normal position.

Pitch adjuster 20 is installed by positioning the assembled pitch adjuster 20 on fixed tube 26 so that the outward end extends to tuning slide crook 28. Ring 34 is then soldered to fixed tube 26. With the pitch adjuster mechanism in its normal position, ring 68 is then soldered to fixed tube 26. Pitch adjuster 20 is then attached to tuning slide crook 28, and the instrument is tuned. This is done in one of two ways: In the first, ring 80 is positioned on tuning slide crook in alignment with pitch adjuster 20 and soldered in place. Neck 78 of tuning piece 74 is fit into ring 80 and tuning piece 74 is secured to ring 80 with end cap 84. Turning knurled knob 76 causes tuning piece 74 and thus tuning slide crook 28 engaged thereto to move inward or outward, permitting the instrument to be tuned. In the second way, block 94 is positioned on tuning slide crook 28 in alignment with pitch adjuster 20, and soldered in place. The tip of tuning piece 86 is inserted in bore 96 of block 94 until groove 92 is engaged by spring arm 102. Turning knurled knob 88 causes tuning piece 86 and thus tuning slide crook 28 engaged thereto to move inward or outward, permitting the instrument to be tuned.

Once pitch adjuster 20 is properly installed and the instrument tuned, and actuating handle 42 is adjusted to the particular musician so that the pitch adjuster 20 can be operated without interfering with the musician's established technique. The position of knob 44 can be adjusted axially, by inserting handle 42 into various holes 40 in handle bracket 36; angularly, by loosening cap 38 and turning handle bracket 36; and radially, by loosening set screw 50 and moving knob 44 with respect to pin 48. Some musicians may find it preferable to operate the device by operating tuning slide crook 28 directly, rather than by handle 42. In this mode, pitch adjuster 20 still provides stopped inward and outward positions and automatically returns the tuning slide crook to the normal position.

To lower the note played 14 cents, the musician simply pushes outward on knob 44, which causes rod 24 to move outward, pushing tuning slide crook 28 outward until handle bracket 36 engages ring 34, at which point tuning slide crook 28 will have moved out a total distance (o). During this outward movement, the outward end of spring 70, engaged by ring 68, is held from an outward movement, while the inward end of spring 70, engaged by shoulder 72 of auxiliary rod 64, is pushed forward with movement of rod 24. Thus outward movement of rod 24 and tuning slide crook 28 causes spring 70 to compress. This is shown in FIG. 8, where pitch adjuster 20 is shown in the stopped outward position. The pitch adjuster will remain in the outward position until released, at which time the expansion of spring 70 acting between ring 68 and shoulder 72 of auxiliary rod 64 pushes rod 24 inwardly to the normal position, where connector 60 engages ring 68.

To raise the note played 16 cents, the musician simply pulls inwardly on knob 44, which causes rod 24 to move inwardly, pulling tuning slide crook 28 inwardly until spring retainer 54 engages ring 34, at which point tuning slide crook 28 will have moved inwardly a total distance (i). During this inward movement, the inward end of spring 56, engaged by connector 60 which is held in place by ring 68, is held from inward movement while the outward end of spring 56, engaged by nut 58 on spring retainer 54, is pulled inwardly with the inward movement of rod 24. Thus, inward movement of rod 24 and tuning slide crook 28 causes spring 56 to compress. This is shown in FIG. 9, where pitch adjuster 20 is shown in the stopped inward position. The pitch adjuster will remain in the inward position until released, at which time the expansion of spring 56 acting between connector 60 and nut 58 on spring retainer 54 pushes rod 24 outwardly to the normal position, where connector 60 engages the outward end of cylindrical sleeve 32 at juncture 62.

The mechanism for restoring the pitch adjuster to a normal position from the outward position and the mechanism for restoring the pitch adjuster to the normal position from an inward position are thus separate and do not operate against each other. This permits an extremely fast return time, to allow the musician to use the pitch adjuster under real playing conditions. When desired, as for cleaning or repair, the device can be quickly disengaged from the tuning slide crook in the first embodiment by removing nut 84 from tuning piece 74 and simply sliding crook 28 free, or in the second embodiment by depressing button 104 on block 94 until spring arm 102 no longer engages circumferential groove 92 in tuning piece 86, and pulling tuning slide crook 28 free.

EXAMPLE

For example, suppose the musician wishes to play the major scale based on C, closely approximating the scale of just intonation. The musician would install pitch adjuster 20 and tune the instrument. The musician would then play the key note "C" in the normal position, and be in perfect tone; play the second note "D" in the normal position, and be only 4 cents high; play the third note "E" with the pitch adjuster in the out position, and be in perfect tone; release pitch adjuster 20 which automatically returns to the normal position and play the fourth note "F", and be 2 cents low; play the fifth note "G", and be only 2 cents high; play the sixth note "A" with the pitch adjuster 20 in the out position, and be only 2 cents high; play the seventh note "B" with the pitch adjuster in the out position, and be only 2 cents low. Thus, with applicant's pitch adjuster 20, the musician has succeeded in playing the C major scale, deviating from the scale of just intonation by only 4 cents on the high side and 2 cents on the low side. The pitch adjuster also corrects imperfections in an instrument's basic tuning characteristics. For example, the fifth harmonic which is (−) low in the scale of equal temperament can be adjusted to "O". Similarly, the sixth harmonic, usually sharp (+) on most instruments, can be instantly lowered to "O". The pitch adjuster 20 allowing a quick succession of notes because of its fast mechanism restoring the instrument to its normal position before the play of the next note. The musician can make up these minor differences by lipping, without destroying the quality of the note.

It will be appreciated by those skilled in the art that although specific designs have been described in detail, that they are merely illustrative of the invention. The invention is not to be limited to the specific embodiments disclosed, but is to be limited only by the scope of the appended claims.

I claim:

1. In a pitch adjuster for a valved brass instrument, said valved brass instrument having a tuning slide crook telescopically mounted to stationary tube members, said pitch adjuster having means to selectively operate the tuning slide crook between a normal position, preselected inward position, and preselected outward position to raise or lower the note played, and means to automatically restore the tuning slide crook to the normal position, the improvement comprising positive detent means at the normal position, said detent means having stopping means to limit the automatic restoring means to prevent overtravel of said crook upon return to the normal position from either the outward or inward position.

2. The device of claim 1 wherein the pitch adjuster further comprises a main operating rod, and an auxiliary rod, the detent means further comprising a spring surrounding each of said rods, and means to compress only one of said springs as the pitch adjuster is moved to either the outward or inward positions.

3. The device of claim 2 wherein the main rod has two portions, each portion having a different cross-sectional shape, and wherein the detent means further comprises a connector extending between said main and said auxiliary rods, said connector having means defining an opening of the same cross-sectional shape as one of said main rod portions, and being slidably mounted thereon.

4. The device of claim 3 wherein the detent further comprises a ring adapted to be secured to one of said stationary tube members, said ring having means defining an opening of the same cross-sectional shape as the other of said main rod portions, and being slidably mounted thereon.

5. The device of claim 4 further comprising a second ring adapted to be secured to the same said stationary tube member, said ring having means defining an opening and slidably mounted thereby to the auxiliary rod.

6. The device of claim 3 wherein one of said main rod portions is circular in cross-section, and the other is polygonal in cross-section, the corners of said polygon extending outside the circumference of said circle.

7. The device of claim 6 wherein the polygonal shape is that of a hexagon.

8. The device of claim 2 further comprising means mounted an end of the main operating rod to the tuning slide crook.

9. The device of claim 8 wherein the rod and mounting means comprises a block mounted to the tuning slide crook, means defining an opening in the block to receive the main rod end, the main rod having a circumferential groove and adapted for insertion in said opening, and the block having means to resiliently engage said groove and thereby retain the main rod.

10. The device of claim 9 wherein the main rod further comprises a tuning piece threaded thereon, the groove being in said tuning piece.

11. The device of claim 9 wherein the resilient engaging means comprises a spring extending tangentially through the block opening and a button mounted on the end of the spring to facilitate its operation.

* * * * *